US005203669A

United States Patent [19]

Klossek et al.

[11] Patent Number: 5,203,669

[45] Date of Patent: Apr. 20, 1993

[54] GARBAGE TRUCK

[75] Inventors: Johannes Klossek; Johannes Kirchhoff, both of Iserlohn, Fed. Rep. of Germany

[73] Assignee: Waste Management of North America, Inc., Oak Brook, Ill.

[21] Appl. No.: 939,404

[22] Filed: Sep. 1, 1992

Related U.S. Application Data

[63] Continuation of Ser. No. 691,535, Apr. 25, 1991, abandoned.

[51] Int. Cl.[5] ..... B65F 3/14

[52] U.S. Cl. ..... 414/525.2; 100/50; 100/53; 100/100; 198/718; 198/719; 198/747; 414/517

[58] Field of Search ..... 414/509-517, 414/525.1, 525.2; 100/50, 53, 100, 137, 299 A, 233; 198/718, 719, 747

[56] References Cited

U.S. PATENT DOCUMENTS

| | | | |
|---|---|---|---|
| 820,528 | 5/1906 | Southam | 198/747 X |
| 3,289,572 | 12/1966 | Pioch | 414/509 X |
| 3,799,051 | 3/1974 | Liberman | 100/229 A X |
| 3,802,335 | 4/1974 | Longo | 100/50 X |
| 3,865,260 | 2/1975 | Wieschel et al. | 414/517 |
| 4,135,444 | 1/1979 | White et al. | 100/50 |
| 4,157,643 | 6/1979 | White | 100/50 X |
| 4,643,087 | 2/1987 | Fenner et al. | 100/229 A X |
| 5,064,332 | 11/1991 | Edelhoff et al. | 414/517 X |

FOREIGN PATENT DOCUMENTS

| | | |
|---|---|---|
| 0163859 | 12/1985 | European Pat. Off. . |
| 1145995 | 12/1985 | European Pat. Off. . |

*Primary Examiner*—David A. Bucci

*Attorney, Agent, or Firm*—Allegretti & Witcoff, Ltd.

[57] ABSTRACT

An improved garbage truck is disclosed having an inlet opening leading into a tipping section, where a press reciprocally moves in the tipping section, guided along the side walls thereof, to propel garbage through an opening into a removable container. The tipping section has at least one lateral arm or wall reinforcing the side walls of the tipping section and is arranged above the press. A sensing element is arranged in the tipping section with generates a signal when there is a jam or when there are tilted or bulky objects, the signal stops the travel of the press or reverses the direction of the press to prevent damage to the garbage truck.

6 Claims, 3 Drawing Sheets

GARBAGE TRUCK

This application is a continuation of application Ser. No. 07/691,535, filed Apr. 25, 1991, now abandoned.

BACKGROUND OF THE INVENTION

1. Field of the Invention

This invention refers to a garbage truck with a garbage inlet opening leading into a tipping section, with a press means being reciprocably movable in the tipping section and guided along the side walls thereof, said press means propelling the discharged garbage through an opening into a receptacle, preferably into a container designed as an interchangeable container with detachable couplings, and with at least one lateral arm or wall reinforcing the side walls of the tipping section and being arranged above the press means.

2. Description of Prior Art

A garbage truck of said kind is already known e.g. from the European Patent Publication EP 0 163 859 A2. In this garbage truck, the garbage inlet opening is located in the front section of the vehicle, partially above the cab and partially between this cab and the container in the area behind and above the cab, wherein a lifting and tipping device picks up the garbage cans for emptying them into the garbage inlet opening. The press means being guided in the tipping section is reciprocably moved by hydraulic piston cylinder units such that said press means propels the garbage discharged into the garbage inlet opening through an inlet opening provided with a sealing means into the container. Therein the press means can be moved into the container in the manner as shown in FIG. 2 of the document EP 0 163 859 A2 through the sealable inlet opening of the container so that the garbage is compressed in the container with increasing filling thereof. Since the press means propelling the garbage from the tipping section to the container exercises considerable pressure forces in the tipping section with increasing compression of the garbage, the side walls of the tipping section are reinforced by a lateral arm arranged above the guidance for the press means. Instead of a lateral arm, also walls of the inlet opening covering the tipping section can be used for reinforcing the walls of the tipping section.

When objects protruding over the upper edge of the press means are discharged into the tipping section, e.g. logs or iron girders or the like, said objects can get jammed between the press means and the lateral arm or wall parts, in particular if they are in an oblique position, which can result in deformations and damages of the lateral arms or wall parts. Oblique or tilted parts can also get jammed between the press means and the upper edge of the single opening of the container so that the container is damaged and a sealing thereof might be impossible.

SUMMARY OF THE INVENTION

Therefore it is an object of the invention to provide a safety means for a garbage truck of the kind mentioned hereinbefore, which prevents damages of the garbage truck caused by objects discharged in the tipping section and getting jammed between the press means and parts of the tipping section or the container.

This problem is solved according to the invention for a garbage truck of the generic type by the fact that in the upper section of the open push-out side of the tipping section a sensing element is arranged which generates a signal when there is a jam or when there are tilted or bulky objects, said signal stopping the travel of the press means or changing the latter's drive to a reverse motion. Thus, the sensing element provided according to the invention prevents that bulky, protruding or oblique objects can get jammed in such a way between the press means and mounting parts of the tipping section or of the garbage inlet opening or of the container that damages occur. Advantageously, when there is a reaction of the sensing element, the drive for the travel of the press means is immediately changed to reverse motion so that due to a corresponding indication, the driver or the operator is informed that tilted or jammed parts lie in the tipping section which must be removed therefrom.

When discharging bulky or longer parts in the garbage inlet opening, it may happen that these objects get jammed therein or get tilted and do not reach the tipping section at all in which they could be seized by the press means. Therefore, in a further development of the invention it is provided that in the upper section of the open push-out side of the tipping section levers or claws being pivotable by a drive are arranged for loosening objects possibly tilted or jammed in the garbage inlet opening from the walls and pressing them into the tipping section such that they can be seized therein by the press means.

Said pivotable levers or claws are advantageously designed such that after retracting the press means they can still press objects protruding out of the garbage inlet opening of the container thereinto so that the container can be sealed. Such objects protruding over the garbage inlet opening can occur in particular when these objects got jammed between the slide-like press means and the edges of the garbage inlet opening so that these objects are carried along during the backward movement of the press means and then are retracted from the container.

It is advantageous that the sensing element consists of at least one projection mounted on a shaft. The shaft can be carried above the open push-out side of the tipping section in the walls thereof. When the sensing element detects tilted or jammed objects, it exercises a torque onto the shaft, and a switch or the like is actuated on rotation of the shaft, which causes the signal to be triggered.

In addition thereto, at the shaft also at least one claw can be fixed so that the shaft can be rotated by a special drive means in order to break up a jam by means of the claw or to press tilted objects into the tipping section or the garbage inlet opening of the container.

Advantageously, the sensing element and/or the claw are designed in the shape of a strip. Thus they are able to monitor the entire width of the tipping section or to intervene along the entire width thereof.

According to a particularly advantageous development the shaft is provided in a crank-like manner with a lever upon the free end of which a hydraulic pressure piston cylinder unit acts. Said pressure piston cylinder unit can be operated as sensing element or as a drive. When no pressure is applied to the piston cylinder unit for the rotation of the shaft, the pressure in the cylinder is increased through the piston, if a torque is exercised on the shaft through the sensing element. Said increase in pressure can be detected by a pressure feeler or pressure switch which then triggers control signals and/or alarm signals.

When the levers or claws are to be operated as slide elements, the piston cylinder unit can be supplied with pressure in a usual way for the rotation of the shaft.

Embodiments of the invention will now be described in the following with reference to the drawings.

DETAILED DESCRIPTION OF PREFERRED EMBODIMENTS

Figure 1:
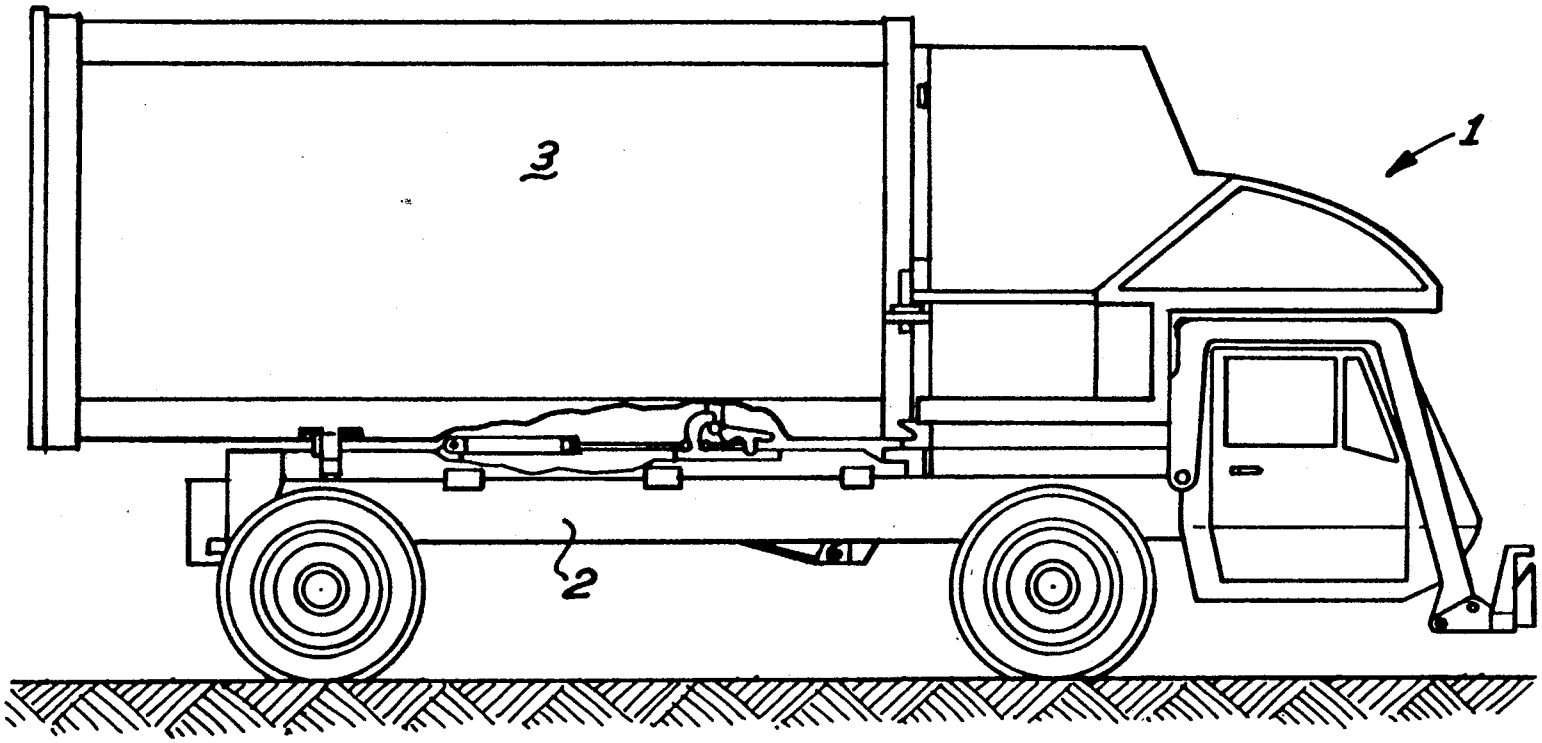
FIG. 1 shows a side view of the garbage truck with a container being coupled to the tipping section and receiving the garbage.
Figure 2:
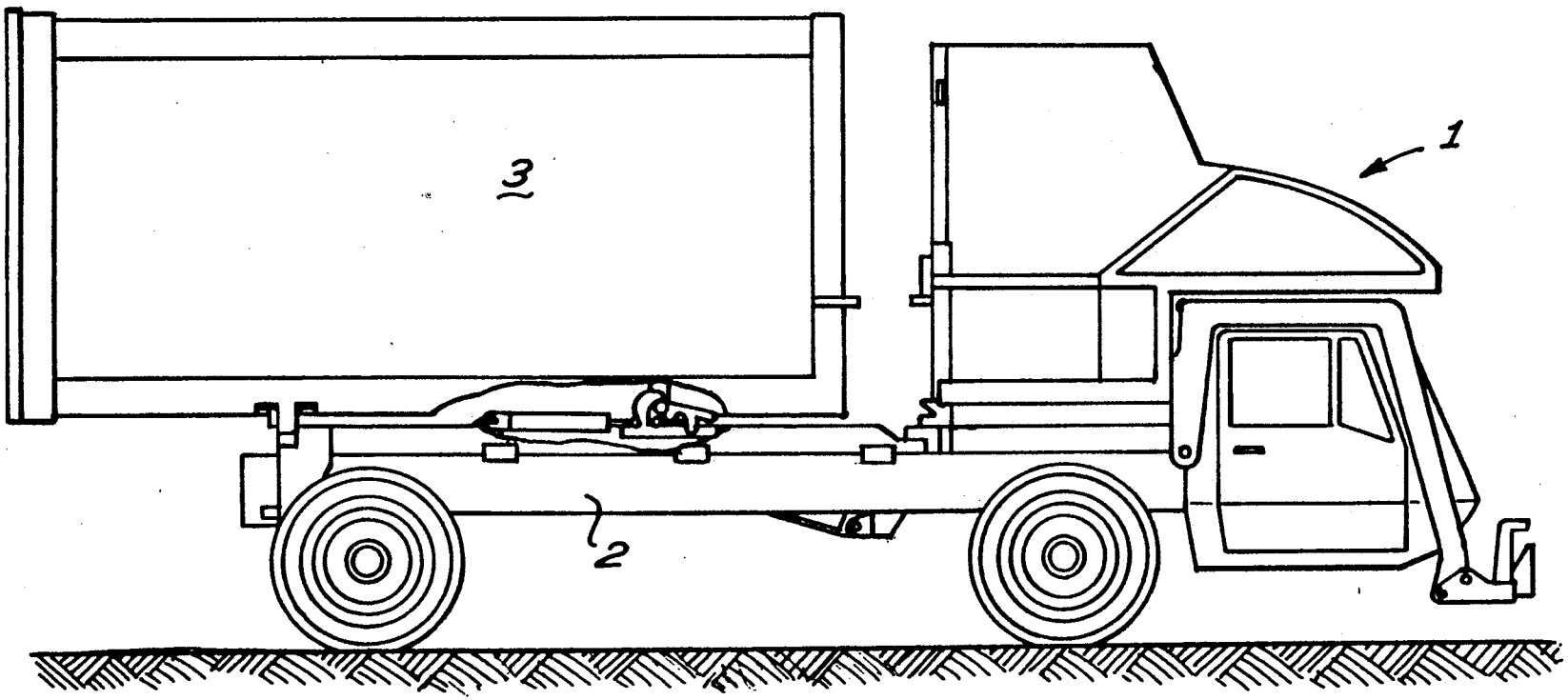
FIG. 2 is a representation of the garbage truck according to FIG. 1, with a container being decoupled from the tipping section and partially being moved away therefrom.

The garbage truck 1 as shown in FIGS. 1 and 2 corresponds in its basic structure to the garbage truck described in the publication EP-0 163 859 A2, so that on the whole reference is made to said document for the detailed description of the garbage truck.

A container 3 designed as interchangeable receptacle is detachably mounted on the vehicle frame 2, the container being provided with a sealable garbage inlet opening at its side facing the cab.

Below the garbage inlet opening 4, there is the tipping section 5 to which the garbage inlet opening 4 leads in a funnel shape. In the tipping section 5, being of rectangular shape in the cross-section, the slide-like press means 6 is guided for a reciprocable movement. The press means 6 comprises a rectangular, slide-like front part 7 and a support sheet metal 8 being connected therewith by forming a right angle. The press means 6 is provided with lateral guiding rails 9 which are guided in the guiding grooves 10 formed in the side walls of the tipping section 5 by U-shaped beams recessed therein.

For the reciprocable movement of the press means, at the back side of the front slide part 7 thereof, the piston rods are linked by intersecting hydraulic cylinders 12, 13, the cylinders of which are linked to the rearward side wall of the tipping section facing the cab. In that, the tipping section and the design of the press means and of the hydraulic cylinder for the moving thereof correspond to the embodiment described on the basis of FIGS. 6 to 8 according to publication EP 0 163 859 A2, the piston rods, however, being directly linked to the front press means and no toggle lever linkage being used.

Above the guidings 10 formed by the U-shaped beams, the side walls 15, 16 of the tipping section 5 are reinforced by a transversely extending lateral arm (not shown) or by the transversely extending wall of the garbage inlet opening 4.

Close above the path of movement of the press means 6, in the side walls 15, 16 of the tipping section or in carriers 17, 18 connected therewith, a shaft 19 is carried with its shaft journals rising above the carrier 17 and a lever 20 being mounted crank-like thereon, to the free end of which the connection rod of a hydraulic cylinder 22 is linked which is flexibly joined by the flexible hinge 23 with the side wall 15 of the tipping section 5 or another part fixedly arranged at the vehicle.

Shaft 19 is connected with a strip 24 having an approximately nose-like profile and with a strip 25 constituting a slide and forming an obtuse angle therewith. In the represented position corresponding to the normal tipping operation, the nose-like strip 24 lies close above the upper edge of the press means 6 and is slightly inclined in direction to the garbage input opening 27 of the container 3. In said position ready for operation, the strip 25 constituting a pivotable slide is in an approximately horizontal position to the sliding plane of the press means 6.

Figure 3:
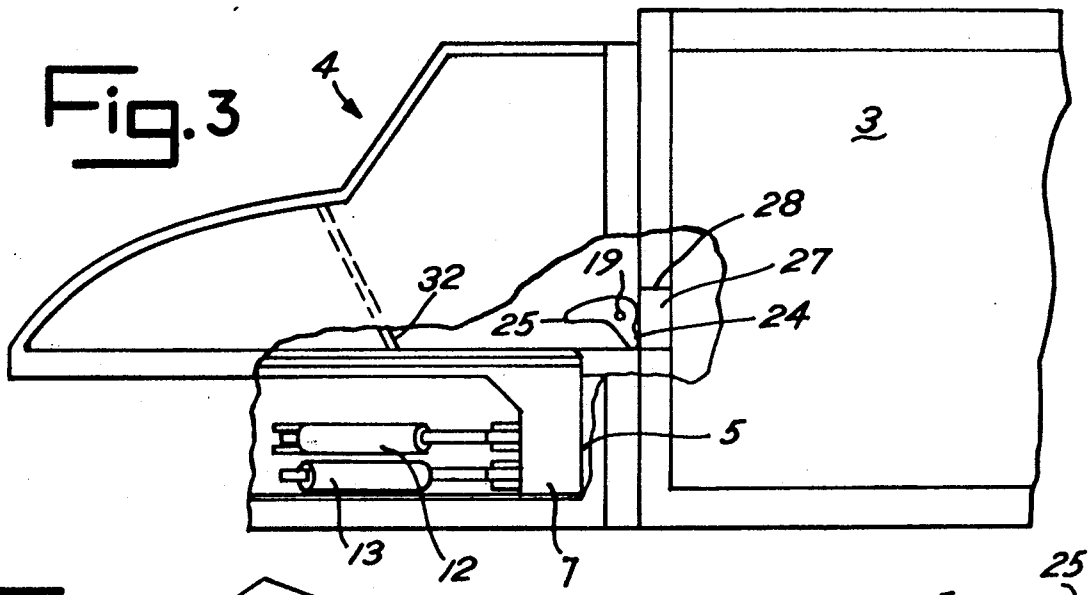
FIG. 3 shows an enlarged partial view of a garbage truck as shown in FIG. 1, in which a sectional view of a preferred embodiment of the tipping section of the present invention is illustrated.
Figure 4:
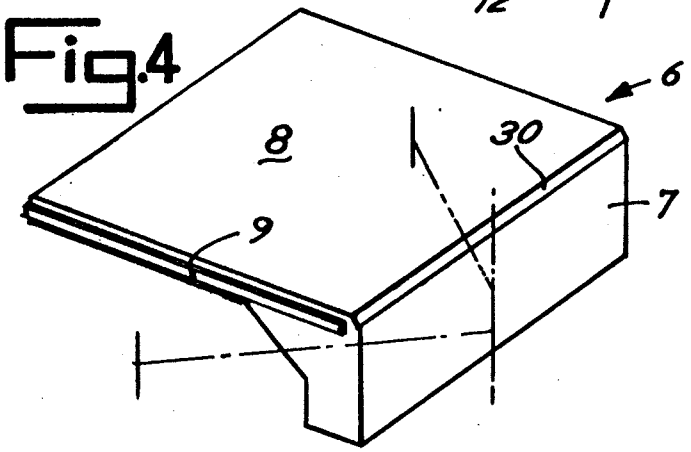
FIG. 4 shows a perspective view of the press means being reciprocably movable in the tipping section.
Figure 5:
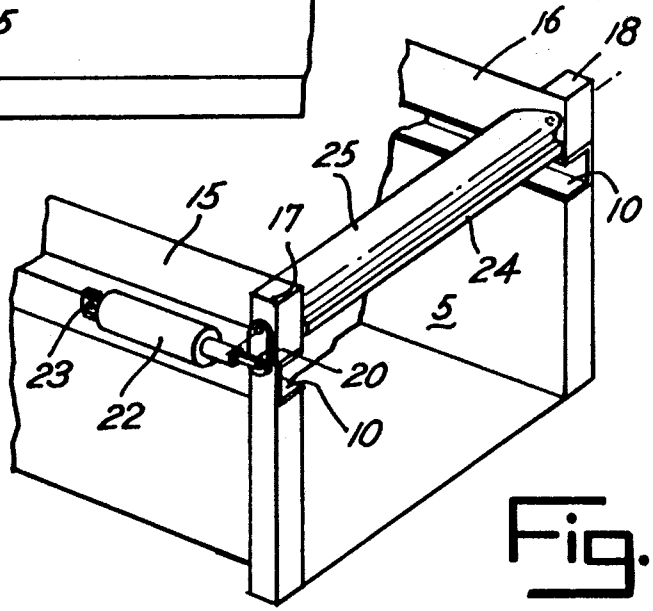
FIG. 5 shows a perspective view of the front side of the tipping section.

As can be seen from FIG. 3, the shaft 19 is arranged close below the upper edge 28 of the garbage inlet opening 27 in the end portion of the tipping section or in the border section between the garbage inlet opening and the tipping section so that the nose-like strip 24 constituting a sensing element is activated when bulky or transversely lying parts are jammed between the strip 24 and the upper edge 30 of the press means 6.

Additionally, also the slide-like strip 25 has the function of a sensing element since said strip is also pivoted when bulky or jamming parts come to lie between said strip and the press means.

The upper edge 30 of the press means is inclined in the represented manner in order to enable a better sliding of objects for avoiding a jam.

If during the tipping and propelling operation a torque is exercised on the shaft 19 through discharged objects pushing against the strips 24 or 25, the pressure of the pressure means in the cylinder 22 is increased which is monitored by a pressure feeler or the like. When said pressure exceeds a critical value, a signal is generated which changes the switching of the hydraulic cylinder 12, 13 so that the press means is moved in its retracted position and the operator can remove objects being tilted or causing a jam from the tipping section or the garbage inlet opening.

When the driver is informed of a jam above the tipping section in the garbage inlet opening by sensing means (not shown), he can break up said jam by rotation of shaft 19 through operating the hydraulic cylinder 22.

Furthermore, there is the possibility to press objects protruding out over the garbage inlet opening 27 by means of the claw-like strip 25 into the container 3 by a corresponding operation of the hydraulic cylinder 22.

A jam or tilting of objects above the tipping section 5 in the garbage inlet opening 4 can occur when objects are jammed e.g. between the funnel-shaped inclined wall 32 and the opposite wall of the garbage inlet opening. If such a jam occurs, the objects can be pressed down by pivoting the claw-like strip 25 in the tipping section 5, so that the objects can be seized by the press means 6.

The shaft 19 is of course controlled such that the press means 6 cannot be moved towards the claw-like strip 25.

We claim:

1. A garbage truck comprising:

a garbage inlet opening leading into a tipping section having side walls, an upper section, and an open push-out side;

means for pressing in a reciprocally moveable motion in the tipping section, said pressing means having an upper edge and being guided along the side walls and propelling discharged garbage through a receptacle inlet opening into a removable receptacle;

at least one lateral member reinforcing the side walls of the tipping section and being arranged above the press means;

a shaft pivotally mounted in the upper section of the tipping section in close proximity to both the receptacle inlet opening and the upper edge of the press means, said shaft having a claw means for pressing down and freeing objects seized by the press means;

means for pivoting said shaft and activating said claw means when objects are seized by the press means;

a sensing element integrally associated with the shaft, the sensing element generating a signal when there is an obstruction, said signal stopping the reciprocal movement of the press means.

2. The garbage truck according to claim 1, wherein the pivoting means comprises a lever engaged with a hydraulic pressure piston cylinder.

3. The garbage truck according to claim 1, wherein the sensing element comprises at least one projection mounted on a shaft.

4. The garbage truck according to claim 1, wherein the sensing element has the shape of a strip.

5. The garbage truck of claim 1, wherein the signal reverses the reciprocally movable motion of the press means.

6. The garbage truck of claim 1, wherein the claw means has a strip shape.

* * * * *